United States Patent [19]

Birkle et al.

[11] 4,425,211

[45] Jan. 10, 1984

[54] DEVICE FOR ELECTRODEPOSITION OF ALUMINUM

[75] Inventors: Siegfried Birkle, Hoechstadt; Johann Gehring, Spardorf; Klaus Stoeger, Nuremberg, all of Fed. Rep. of Germany

[73] Assignee: Siemens Aktiengesellschaft, Berlin & Munich, Fed. Rep. of Germany

[21] Appl. No.: 393,198

[22] Filed: Jun. 28, 1982

[30] Foreign Application Priority Data

Aug. 21, 1981 [DE] Fed. Rep. of Germany ..... 3133162

[51] Int. Cl.[3] ..... C25D 17/02; C25D 21/02

[52] U.S. Cl. ..... 204/198; 204/202; 204/274

[58] Field of Search ..... 204/198, 202, 203, 274, 204/275

[56] References Cited

U.S. PATENT DOCUMENTS 4,176,034 11/1979 Stoger ..... 204/199
4,265,726 5/1981 Herrnring et al. ..... 204/202
4,363,712 12/1982 Birkle ..... 204/199

FOREIGN PATENT DOCUMENTS 2719680 11/1978 Fed. Rep. of Germany ..... 204/203
2901586 7/1980 Fed. Rep. of Germany ..... 204/202

*Primary Examiner*—T. Tufariello
*Attorney, Agent, or Firm*—Hill, Van Santen, Steadman & Simpson

[57] ABSTRACT

A device for electrodepositing aluminum from an aprotic, oxygen-free, water-free aluminum-organic electrolyte, which comprises an electroplating tank, which is subdivided into a plurality of identical individual cells for receiving an electrolyte and anode plates, which cells contain support racks and are positioned one after another in a line or row, and the tank has a hood forming a protective chamber which contains a protective atmosphere. To charge and discharge workpiece holders into and out of the device includes a charging lock at one end of the row of cells forming the tank, a discharging lock at the other end of the row and a conveyor in the tank.

20 Claims, 9 Drawing Figures

DEVICE FOR ELECTRODEPOSITION OF ALUMINUM

BACKGROUND OF THE INVENTION

The present invention is directed to a device for electrodepositing of aluminum from an aprotic, oxygen-free and water-free aluminum-organic alectrolyte. The device comprises an electroplating tank for receiving a liquid and an anode plate and having a hood forming a protective chamber over the surfaces of the liquid and being closed to the outside with the protective chamber being filled with a protective atmosphere, an arrangement for conveying workpiece holders in the protective chamber for introduction into a support rack for electrically contacting and holding the workpiece holder while disposed in the liquid of the tank, and a pair of lock arrangements each including an antechamber, a liquid lock and a principal chamber, which is connected to the protective chamber through closable openings with one lock arrangement being a discharging lock and the other being a charging lock.

A device for electrodepositing of aluminum from an aprotic, oxygen-free, water-free aluminum-organic electrolyte, which device has a lock system with a liquid lock for introduction and removal of the goods to be electroplated is disclosed in U.S. Pat. No. 4,265,726 which was based on German OS No. 2,901,586. In the device of this patent, the goods, which are to be electroplated, are accommodated on workpiece supports or workpiece holders which can be introduced with the assistance of an endless conveyor belt from an antechamber floodable with an inert gas through a liquid lock and into an electroplating bath or vat. After the electroplating has been accomplished, the holder is again transferred in the reverse direction with the assistance of the same conveyor belts. A disadvantage of this known device is that a rather considerable amount of the electrolyte is entrained from the electrolyte vat or bath into the liquid lock. Due to this continuing contamination of the liquid forming the liquid lock with the electrolyte, an unavoidable reaction with traces of air or moisture in the antechamber flooded with the inert gas will occur. These reaction products cannot be prevented from being deposited at unfavorable locations on the workpice, which is to be aluminized and which was previously cleaned, as the workpiece is transported into the electroplating space through the liquid lock which acts both as a charging and discharging lock. Therefore, these parts can no longer be coated with technically usable aluminum coatings.

In an earlier patent application, U.S. Ser. No. 318,812, filed Nov. 6, 1981 which issued as U.S. Pat. No. 4,363,712 and is based on German patent application No. 3,044,975, a charging lock is provided for introducing of the workpiece holders or carriers and also a discharging lock is provided for allowing the removal of the workpiece holders containing the plated workpiece. In order to increase the amount of throughput, it is further proposed that the known electroplating tank be employed with an annular closed electroplating vat in which a multitude of workpiece holders can be simultaneously accommodated. For this reason, the electroplating tank contains a support device for the workpiece holders which both contacts and holds the workpiece holders. This device is rotatable around a vertical axis of rotation and has brackets for receiving each of the workpiece holders so that they are moved in a circular arc or path in a substantially horizontal plane. As a result of the annular design of the electrolyte bath or vat, the workpiece holders can be moved through the electrolyte in a circular path and by so doing can be coated with aluminum at a higher current density. Moreover, as a result of the annular design of the electrolyte bath, the spatial separation of the charging and discharging of the workpiece holders through separate charging and discharging locks is made possible so that the individual brackets can be simultaneously loaded and emptied clockwise without sufficient interruptions. With the assistance of the known endless chain conveyors, the workpiece holders carrying the workpiece are introduced from a prelock, or antechamber, which is flooded with inert gas, through a U-shaped liquid lock into a principal chamber which is filled with inert gas and then are automatically transferred into the electroplating tank where the workpiece holder is received on the support device that has electrical contacts. After electroplating, the workpiece holders are automatically removed from the brackets of the support device with the assistance of an additional endless chain conveyor and are transferred through the liquid lock of the discharging lock into a prelock.

However, since the device of the copending application utilizes a closed, annularly shaped electroplating vat or bath, it is subjected to limits with regard to its size. For example, the size of the bath cannot be easily changed without substantial structural cost particularly for the rotatable support means which has the electrical contacts for the workpiece holders and for the structure of the bath.

SUMMARY OF THE INVENTION

The present invention is directed to creating a device for electroplating aluminum, which device is significantly simpler in terms of its structure than the previously known devices and which device can be enlarged or expanded practically without significantly additional cost in order to increase the throughput. This goal is achieved by providing a device for electrodepositing aluminum from an aprotic, oxygen-free, water-free aluminum-organic electrolyte, said device comprising an electroplating tank being subdivided into a plurality of identical individual cells for receiving an electrolyte and anode plates, each of said cells having a rectangular cross section and being positioned one after another in a line, said electroplating tank having a hood forming a protective chamber over the surface of a liquid in said cells, said chamber being closed to the outside and having means for providing a protective atmosphere in the chamber, each of said cells containing support means for electrically contacting and holding workpiece holders being disposed in the cell to present workpieces for contact with the liquid in the cell, said electroplating tank at one end of the row of cells having a first lock means for forming a charging lock and at the other end of the row of cells having second lock means for forming a discharging lock, each of said lock means including an antechamber, a liquid lock and a principal chamber being connected to the protective chamber through closable openings so that a workpiece holder can be passed through the first lock means to enter the tank and be removed from the tank through the second lock means without the protective atmosphere and liquid in the electroplating tank becoming contaminated by the ambient atmosphere outside of said tank; and said tank having conveying means for receiving workpiece holders from said first lock means and depositing them in the cells and for removing workpiece holders from said cells and transferring them to said second lock means.

The subdivision of the electroplating tank into individual cells has the significant advantage that the aluminized device can be constructed in a modular system or form. Thus, it practically can be randomly expanded whereby individual cells which are preferably designed as container units can be added. Since each individual cell forms a self-contained system, the supply vessel for the electrolyte need to be practically designed only for the content of the individual cell, the overall installation need not be shut down but rather the shutdown of only one cell or bath is necessary. Another advantage of the device having a plurality of individual cells is that an individual bath can be operated with different current strengths whereby no mutual influencing of the bath can occur. One is even in a position to work with different electrolytes in the individual cells so that the conditions regarding heating and cooling can be matched as desired. In comparison to an annular or ring cell, the device of the present invention adds a considerable advantage that the device requires no rotating parts which not only require considerable cost but also are in need of constant maintenance.

Advantageously, a plurality of workpiece holders or carriers can be simultaneously employed in each of the individual cells. This has the advantage that the charging of the individual cell can proceed very quickly particularly when the spatial disposition of the workpiece holders or carriers while being transported on the conveying means corresponds to the spatial disposition of the workpiece carriers or holders in each of the individual cells.

Preferably, the width of each of the anode plates which were disposed on both sides of the workpiece holders will approximately correspond to the width of the workpiece holder or carrier and thus the anode plates can be inroduced into the individual cells of the electroplating tank with the conveying means which is used for transporting the workpiece holders. This is an additional significant advantage over the annular cell systems because the anode consumption can be more easily determined in the device of the present invention. Also, with a given consumption, the anodes can be replaced without further ado.

The support means or device for carrying and contacting of the workpiece holders or carriers is situated in each of the individual cells. Preferably, the device includes mounting means for mounting each of the support means which mounting means can be constructed to enable a periodic moving back and forth of the support means over a preferably adjustable stroke which is parallel to the anode plates. In this manner, the advantage of a ring cell, which advantage is that the workpiece holders periodically move back and forth relative to the anode plates in order to make an increase of the current density possible, is also achieved in the electroplating tank which is subdivided into rectangular individual cells in accordance with the present invention. So that a change of the anode plates can be easily undertaken in the device having the movable support means, an additional anode plate, whose width corresponds to the maximum stroke of the support means in the individual cells, is provided and is aligned parallel to the anode plates which are allocated to the workpiece holders. By so doing, it is possible to change the anode plates by using the same conveyor means which is used for transporting the workpiece holders. For the purpose of introducing and withdrawing as well as for inserting of the additional anode plates, the conveyor means is preferably equipped with an additional lift means so that the replacement of all anode plates of a row can be simultaneously undertaken.

The conveying means for introducing and withdrawing the workpiece holders into and respectively out of the individual cells of the electroplating tank are preferably designed in such a manner that a plurality of workpiece holders can be simultaneously conveyed into and/or respectively out of the electroplating tank and through each of the lock means. Thus, it is expedient that the workpiece holders can be introduced or respectively withdrawn from each of the lock means through vertically extending shafts which extend vertically out of the top of the housing of the lock means and which form the antechambers. These vertically extending shafts have a lower portion, which always extends below the surface of the liquid in the housing which forms the liquid lock. The housing of each of the lock means not only includes the liquid lock, but also the principal chamber is formed above the liquid surface. Each of the liquid locks preferably contains a conveyor means, which moves the workpiece holders therethrough. The conveyor means preferably include a truck or carriage which runs horizontally beneath the surface of the liquid from a position below the shafts to a position below the closable openings that connect the principal chamber to the protective chamber.

The cover or hood, which form the protective chamber over the plurality of cells forming the electroplating tank serves as a condensation zone for the toluol which evaporates from the electrolyte as a result of the current heating that occurs during the electroplating process. In order, on the other hand, to be able to dissipate the Joule effect or current heat which occurs during the electroplating process and on the one hand, in order to produce toluol for washing the coated workpieces which are encumbered with the electrolyte, it is advantageous for the lateral walls of the hood to be provided with a heat exchanger in the form of a cooling coil. However, in certain conditions, the heat exchanger can be heating coils. By providing the heat exchanger in the lateral wall portions of the hood, the additional possibility exists of keeping the temperature of the electrolyte in the individual cells relatively constant. No external heat exchangers with pumps and evaporators are then required for this purpose.

Advantageously, the electroplating tank includes a wash bath, which is in a vessel that is arranged in series with the individual cells and preferably has the same shape and size as the individual cells. In such an arrangement, it is desirable to have condensation channels provided on each of the lateral walls beneath the heat exchanger formed by the cooling coils with each of the condensation channels terminating for discharge into the wash bath. Thus, the excess rinse toluol is expediently resupplied to the individual cells through a level control device so that the overall volume of the electrolyte and toluol will remain largely constant.

Preferably, the hood of the electroplating tank has a low horizontal wall portion adjacent each end with the wall portion of one end having the closable opening that connect the protective chamber to the principal chamber of one lock means and the lower horizontal wall portion of the other end having the closable openings which connect the protective chamber to the other lock means. The conveying means preferably include a horizontally movable truck which is positioned in the hood for movement between a position vertically over the closable openings at one end to a position vertically over the closable openings at the other end and the truck has a plurality of vertically movable hooks which are able to be moved vertically down through the opening for engaging items such as anode plates and workpiece holders which are to be moved through the openings either into or out of the protective chamber. Thus, each of the cells can have its anode plates changed as well as being loaded and unloaded with work holders by this conveying device.

Preferably, the conveying means over the electroplating tank as well as the conveyor means of each of the lock means is driven by means of compressed air so that no rotating motors which would have to be built as explosion-proof motors are required.

DESCRIPTION OF THE PREFERRED EMBODIMENTS

Figures 1, 2:
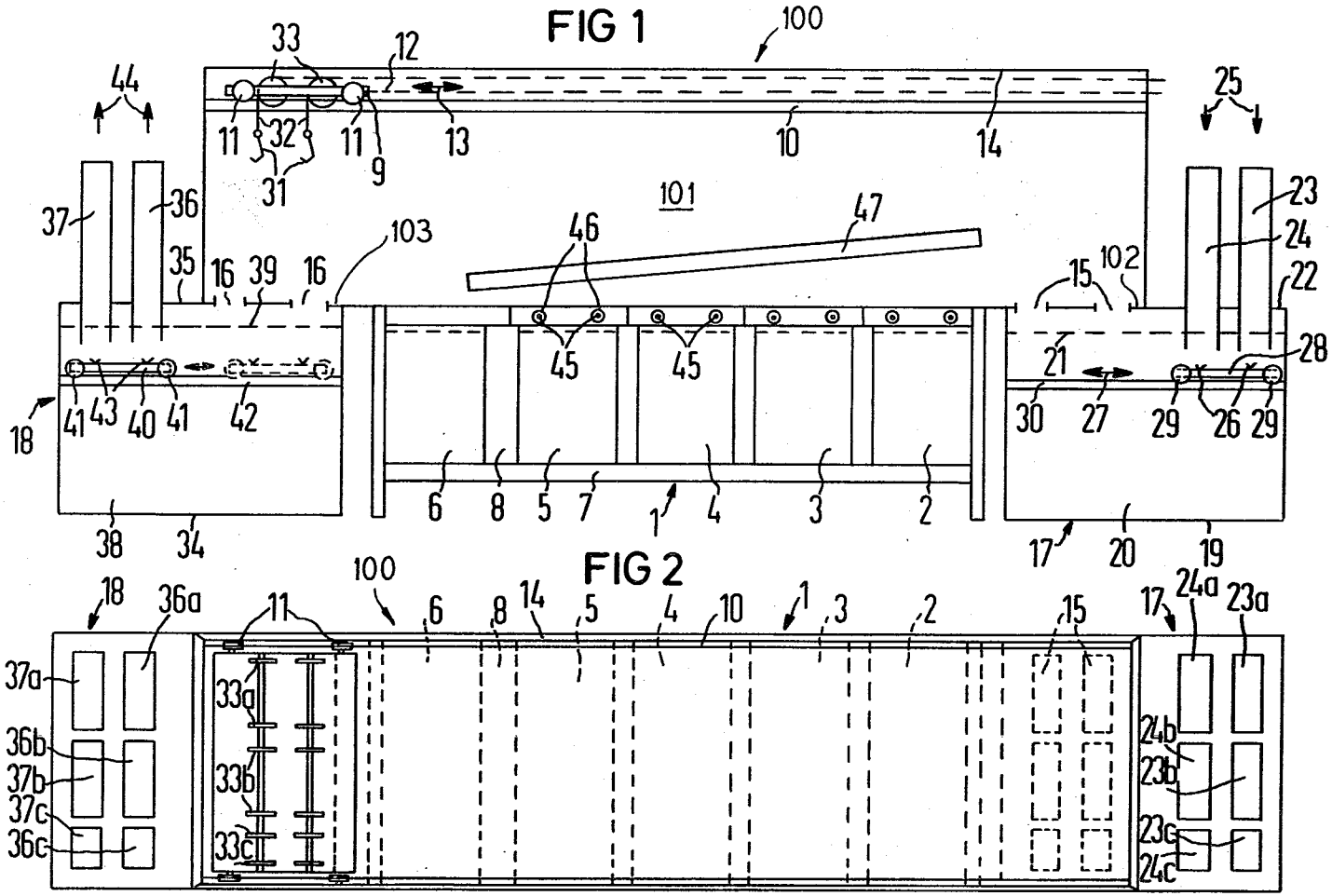
FIG. 1 is a schematic side view of a device or installation for the electrodeposition of aluminum.
FIG. 2 is a plan view of the device of FIG. 1.

The principles of the present invention are particularly useful in a device generally indicated 100 and schematically illustrated in FIGS. 1 and 2. The device 100 includes an electroplating tank 1 which consists of individual cells 2–5, which are mounted in a line or row in a frame 7. Each of the cells 2–5 contains an electrolyte to form individual electroplating baths. The tank 1 in addition to the cells 2–5 also contains an additional vessel 6, which serves as a wash bath and can be filled with a liquid, for example, toluol, which is compatible with the electrolyte that is in the cells 2–5. The dimensions of the vessel 6 are essentially the same as the dimensions of the individual cells 2–5 and thus the vessel 6 and cells 2–5 form practically a single container. As illustrated, the cells 2–5 and the vessel 6 are inserted in a supporting frame 7 preferably from above. As illustrated in FIGS. 1 and 2, the vessel 6 is not directly attached to the last individual cell 5 but is spaced therefrom by a free space 8. This free space can be of any desired size and can be large enough that an additional individual cell similar to the cells 2–5 can be received therein.

As illustrated, the individual cells 2–5 and the vessel 6 for the wash bath are arranged one behind the other so that they lie in a line or row and are provided with a single hood or closing cover 14, which forms a protective chamber 101 above the individual cells of the tank 1 as well as above the bath 6. With the individual cells as well as the vessel 6 being disposed one behind the other in a row, they can be charged and unloaded by utilizing a single conveyor means which is illustrated as comprising a truck or carriage 9, which has rollers 11 that are engaged on rails 10 which are secured to lateral walls of the hood 14. To move the truck along the direction of the arrow 13, a conveyor chain 12 is attached to the truck and extends out of the hood 14 through a gas-tight sealed opening.

The hood 14 has a greater length than the tank 1 and has a lower horizontal wall portion 102 at one end which contains closable openings 15 and has a horizontal lower wall portion 103 at the opposite end which contains closable openings 16. Due to the length of the rails or track 10, the truck 9, while moving in the direction of the double arrow 13, can move from a position directly over the closable openings 16 as illustrated in FIG. 1 to the opposite end where it is disposed directly over the openings 15.

Figure 9:
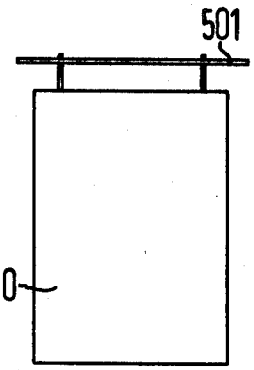
FIG. 9 is a front view of a workpiece carrier or holder in accordance with the present invention.

The closable openings 15 connect the protective chamber 101 to first lock means which form a charging lock 17 and the closable openings 16 are connected to second lock means which form a discharging lock 18. Thus, the locks 17 and 18 are arranged in series or in a row with the cells 2–5 as well as the vessel 6. The charging lock 17 has a housing or vat 19, which forms a chamber 20 for containing toluol, which is compatible with the electrolytes of the individual cells 2–5. The level of the liquid is indicated by the broken line 21. The vat 19 has an upper cover part 22 which acts with the horizontal wall portion 102 to form an enclosed housing and has introduction shafts 23 and 24 which serve as antechambers extending upwardly from the cover part 22. Each of the shafts 23 and 24 has an upper opening to allow introductions of workpiece holders in the direction of arrow 25 and the lower end of each of the shafts 23 and 24 extends below the surface 21 of the liquid 20 in the vat 19. The remaining space above the surface 21 forms a principal chamber of the lock means and is directly connected to the protective chamber 101 by the closable openings 15. The lock means 17 also include a conveyor means which is formed by a truck or carriage 26 that has rollers or wheels 29 that are received on rails or tracks 30 for movement in a horizontal direction indicated by the double arrow 27. The truck 28 is provided with receptacles 26 so that when the truck is positioned as illustrated in FIG. 1 and with the introduction of workpiece carriers or holders 50 (see FIG. 9) through the shafts 23 and 24 (FIG. 1), the holder will be deposited on the receptacles 26. It is noted that when the holder is received in the receptacles 26, it will be completely submerged in the liquid 20. As illustrated in FIG. 9, the workpiece holder 50 has a rack or rod 501 adjacent the top which will be engaged or received in the receptacle such as 26.

After receiving the workpiece holders 50 in the receptacles 26, the truck 28 is shifted along the track 30 to the left. The movement of the truck preferably occurs through the use of a threaded conveyor spindle which can be driven with a compressed air motor which is not illustrated in detail in the drawings.

As mentioned hereinabove, each of the introduction shafts such as 23 and 24 have a lower end that extends into the liquid to form a liquid lock for the workpiece carriers being passed through the introduction shafts in the direction of the arrow 27 and deposited in the receptacle 26. After receiving the goods 26, the truck 28 is moved to the left as illustrated in FIG. 1 to a position beneath the closable openings 15 so that the workpiece holders can be transferred from the truck 28 to the conveyor utilizing the truck 9. As illustrated, the truck 9 has vertically movable hooks 31. The spacing between the hooks 31 is the same as the spacing for the receptacles 26 which in turn is the same spatial position as the center lines of introduction shafts 23 and 24. As indicated in FIG. 1, the hooks 31 are connected by cables 32 which pass over rollers or shafts 33 and extend out of the hood 14 through gas-tight seals.

The discharging lock 18 is constructed in a manner similar to the charging lock 17 and has a vat 34, which has a gas-tight seal with the horizontal wall portion 103 and has also an upper cover or portion 35. Extending through the upper portion 35 are two delivery shafts 36 and 37 which have openings adjacent their upper ends to allow removal of workpiece holders in the direction of the arrows 44 while the lower ends of the shafts 36 and 37 extend into a liquid bath 38 below an upper surface 39 thereof. As in the previously mentioned lock, preferably the vat 34 contains toluol as the liquid. In the vat 34, a conveyor means consisting of a truck or carriage 40 is positioned with its rollers 41 on rails or a track 42 to move horizontally in the direction of the double arrow. As in the previously described carriage 28, the carriage or truck 40 has receptacles 43, which will receive the workpiece holders and have the same spacing as the centers of the shafts 36 and 37, the center of the openings 16, the spacing of the shafts 23 and 24 and the receptacles 26 of the conveyor of the charging lock.

To introduce articles into the device, the workpiece holders are introduced through the introduction shafts 23 and 24 whose opening is then closed and the atmosphere therein is then purged with an inert gas such as $N_2$. After purging, the workpiece holders are lowered by conveyor means in the shaft which is not illustrated so that the holders are engaged in the receptacles 26. After being placed in receptacles 26, the carriage 28 is shifted along the rails 30 to a position with the receptacles vertically below the closable openings 15. After positioning the hooks 31 above the openings 15, the closable openings are opened to allow the hooks to pass through to engage the workpiece holders and raise the workpiece holders off the truck 28 into the chamber 101. After the workpiece holders have been lifted into the chamber 101, the closable openings 15 are closed and sealed with gas-tight seals. Then the workpiece holders on the hooks 31 are positioned over the desired cell and then lowered to be placed therein which will be discussed hereinafter.

After the workpiece holders have been processed in the particular cell, they are engaged by the hooks 31 of the truck 9 and lifted from the particular cell and then moved to a position over the vessel 6 which contains the washing bath. The truck then lowers the work holders into the bath 6 so that they may be washed to remove the electrolyte adhering thereto and subsequently the hooks raise the work holders and transport them to a position directly over the closable openings 16 as illustrated in FIG. 1. After being positioned over the closable openings 16, the openings are opened, the hooks are lowered to deposit the workpiece holders onto the receptacles 43 of the carriage 40 which is in the right-hand position with the receptacles aligned with the openings 16. After being deposited on the carriage or truck 40, the hooks are raised and the openings 16 are closed. During that operation, the truck is moved to the position with the receptacles below the delivery shafts 36 and 37 and conveying means of the shafts (not illustrated engages the workpiece holders and raises them into the shafts in the direction of arrows 44. After being drawn into the shafts 36 and 37, the openings of these shafts are opened so that the workpiece holders can be removed from the discharging lock 18.

It should be noted that both the introduction shafts such as 23 and 24 and the delivery or exit shafts 36 and 37 have means for conveying the workpiece holder introduced therein either downward into the liquid of the liquid lock or upward to remove it from the liquid of the liquid lock. It should also be noted that these shafts, after being opened to allow insertion or removal of the workpiece holder, are purged with an inert gas such as $N_2$.

While a greater detail of the individual cells is not illustrated in FIGS. 1 and 2, it can be seen in FIG. 2 that not only do you have two hooks such as 31 in the truck 9, but that the workpiece holders are also arranged in rows. Thus, the shafts such as 23 and 24 are rows of individual shafts **23*a*, 23*b* and 24*a*, 24*b*. The exit shafts 36 and 37 are arranged as two rows with 36*a* and 36*b* being one row and 37*a* and 37*b* being the next row. In a similar manner, the truck 9 has a plurality of rollers such as 33*a* and 33*b* which are aligned in a row with the same spacing as the shafts. Thus, a total of four workpiece holders can be positioned in each of the cells such as 2–5. Anode plates 56 (see FIG. 3) are situated on both sides of each of the workpiece holders 50 and the anode plates are designed in such a manner that their width practically corresponds to the width of the workpiece holders so that they can be introduced into the individual cells 2–5 and be deposited at the desired location in said cell by the conveyor means 9 and 28. After being consumed or used, the anode plates can also be removed from the cells 2–5 and withdrawn through the discharging lock 18 with the same conveying means such as 9 and 40 and in the same manner as the workpiece holders 50**.

According to an additional proposal of the invention, the relative motion that is required between the workpiece holders and the anode plates in order to increase the deposition rate by means of increasing the current density is provided by the workpiece holders being movable parallel to the anode plates. For this reason, the length of the individual cells 2–5 as well as the vessel 6, is not equal to twice the width of the workpiece holders 50 or the combined width of the anode plates **56*a* and 56*b* (see FIG. 4) which are arranged in a row. However, each of the individual cells has a width which is greater than the width of two anode plates by a magnitude which corresponds to the maximum stroke movement of the workpiece holders 50. Since, however, the workpiece holders must be surrounded by anodes over the entire length of their motion, an additional anode plate such as 56*c* is inserted in each row and in line with the plates 56*a* and 56*b* (FIG. 4) so that regardless of movement of the workpiece holders, it is still disposed between a pair of anode plates. These additional anode plates such as 56*c* are introduced through a separate introduction shaft 23*c*, 24*c* (FIG. 2) and are in turn removed after consumption through delivery shafts 36*c* and 37*c*. Each of the trucks 9, 28 and 24 also are correspondingly provided with hooks or receptacles for receiving the additional anode plates. As illustrated in FIG. 2, rollers 33*c* are provided adjacent rollers 33***a* and 33*b* for conveying the additional anode plates.

Figure 5:
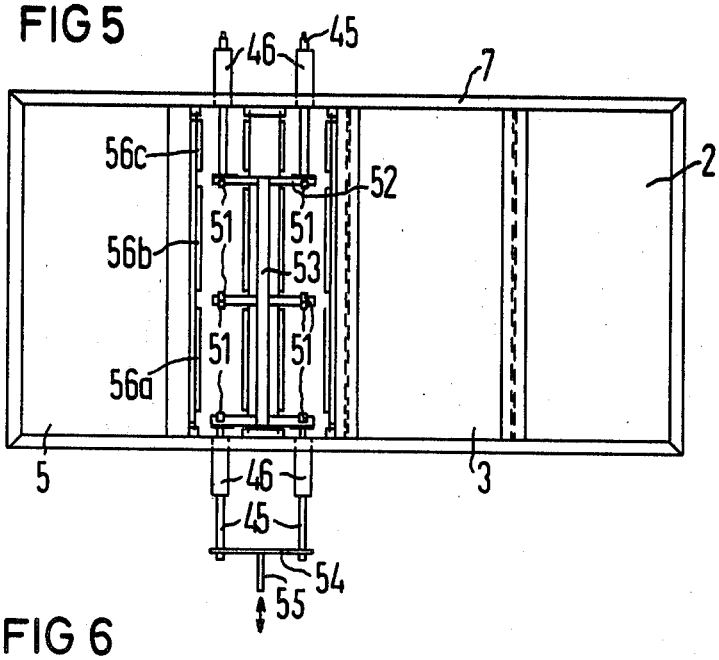
FIG. 5 is a plan view of the device of FIG. 3.

In order to support each of the workpiece holders 50 in the respective one of the individual cells, each of the individual cells is provided with support means, which include cross carriers 52 which are connected to one another by carrying rods 53. The cross carriers 52 are provided with receptacles 51, which receive a conveying rod 501 (FIG. 9) of the workpiece holders 50. The support means is mounted in each cell by mounting means which include tubular guides 46 which slidably receive rods 45 with a seal and as illustrated, the rods 45 on one side of the cell are connected by a cross member such as 54 which in turn transmits reciprocal movement from a push rod 55, which has a maximum stroke about equal to the width of anode plate 56*c*. Thus, the entire support means is shifted in the direction of the double arrow of FIG. 5 to cause each of the workpiece holders to be moved or reciprocated along the row between the anode plates such as 56. The receptacles 51 of the support means electrically connect each of the rods 501 of the workpiece holders as a cathode to a current source. Each of the conveying rods 501 of the workpiece holders 50 is likewise electrically connected to the workpiece supported in the holder.

Figure 3:
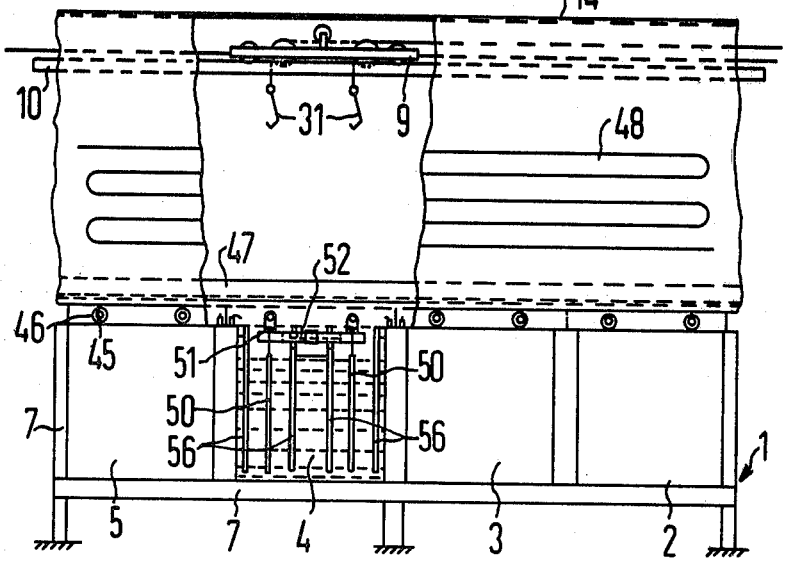
FIG. 3 is an enlarged partial side view of a portion of the installation of FIG. 1 with portions broken away for purposes of illustration.

Referring back to FIGS. 1–3, the relatively large surface of the hood 14 has the advantage that it can be utilized as a condensation zone. The hood 14 may additionally be provided with a heat exchanger coil for either heating or cooling, such as the coil 48 (FIG. 3). When the heat exchanger coils are provided on the hood, then one is in the position to undertake a temperature control of the individual baths for the toluol evaporation of the electrolyte. The condensate is then collected in condensation channels 47 which are disposed under the coils 48, if it is present, and is arranged to discharge into the vessel 6 which contains the rinse solution of toluol. The vessel 6 can also be connected to the individual cells 2–5 so that the same level is in each of these cells.

Figure 6:
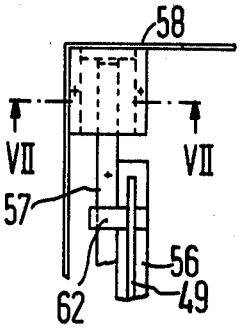
FIG. 6 is an enlarged plan view of a portion of the anode plate suspension.
Figure 8:
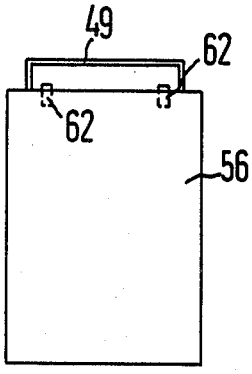
FIG. 8 is a front view of an anode plate in accordance with the present invention.
Figure 7:
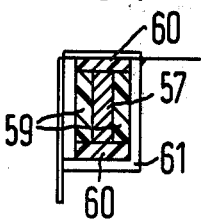
FIG. 7 is a cross-sectional view taken along the lines VII—VII of FIG. 6.

In order to mount each of the anode plates in the cell, each of the individual cells is provided with four live rails 57, which are connected to the electrical source. As illustrated in FIGS. 6 and 7, one rail 57 extends along a side of the cell. The ends of the live rail 57 are mounted in the corner 58 of the cell with the assistance of insulating bodies such as 59 and 60 (see FIGS. 6 and 7) which are secured in the corner 58 with the assistance of an angular support profile or member 61. The anode plates 56 are connected to the live rail 57 by hook-like shackles 62. Thus, when the anode plate is being lowered from the truck 9, the hook-shaped shackles will grasp or engage the live rail 57.

Figure 4:
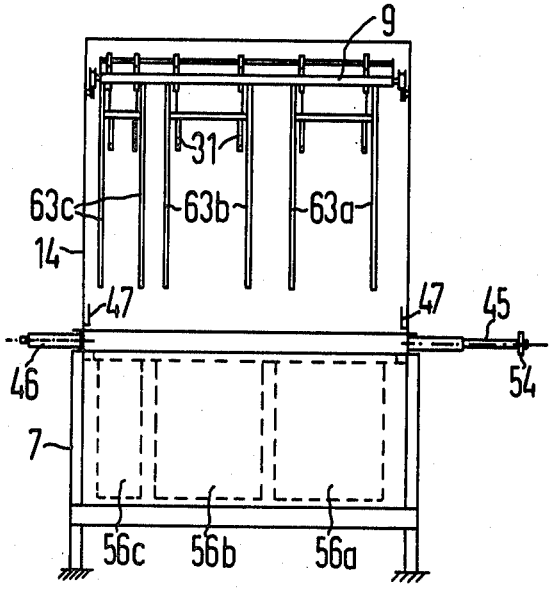
FIG. 4 is a transverse cross-sectional view of the device of FIG. 3.

Since either the workpiece holder 50 or, respectively, the anode plates 56, when being suspended from the hooks 31 could be placed in vibration during the movement of the truck along the rails, the conveying means of the truck 9 may be provided with frame guidance elements 63. As illustrated in FIG. 4, the frame guidance elements are illustrated in three groups 63*a*, 63*b* and 63*c* to prevent oscillation of each element in a row such as 56*a*, 56*b* and 56*c*, respectively, as it is engaged on the hooks 31.

Although various minor modifications may be suggested by those versed in the art, it should be understood that we wish to emobdy within the scope of the patent granted hereon, all such modifications as reasonably and properly come within the scope of our contribution to the art.

We claim:

1. A device for electrodepositing of aluminum from an aprotic, oxygen-free and water-free, aluminum-organic electrolyte, said device comprising an electroplating tank being subdivided into a plurality of identical individual cells for receiving a liquid and anode plates, each of said cells having a rectangular cross section and being positioned one after another in a line, said electroplating tank having a hood forming a protective chamber over the surface of the liquid in said cells, said chamber being closed to the outside and having means for providing a protective atmosphere in said chamber, each of said cells containing support means for electrically contacting and holding workpiece holders being disposed in the cell to present workpieces for contact with the liquid in the cell, said electroplating tank at one end of the row of cells having first lock means for forming a charging lock, and at the other end of the row of cells having second lock means for forming a discharging lock, each of said lock means including an antechamber, a liquid lock, and a principal chamber being connected to the protective chamber through closable openings so that a workpiece holder can be passed through the first lock means to enter the tank and be removed from the tank through the second lock means without the protective atmosphere and liquid in the electroplating tank becoming contaminated by the ambient atmosphere outside of said tank, and said tank including conveying means for receiving workpiece holders from said first lock means and depositing them in the cells and for removing workpiece holders from said cells and transferring them to said second lock means.

2. A device according to claim 1, wherein the support means for each cell holds a plurality of workpiece holders.

3. A device according to claim 2, wherein the support means for each individual cell holds a given number of workpiece holders in the same spatial disposition, each of said lock means having a conveyor means for moving workpiece holders therethrough, said conveyor means of said lock means and the conveyor means for the electroplating tank holding the same given number of workpiece holders in the same spatial disposition as the support means for each cell.

4. A device according to claim 1, wherein each of the cells has means for holding anode plates on both sides of the workpiece holder disposed therein, each of said anode plates having a size corresponding to the width of the workpiece holder, each of the anode plates being constructed and mounted in each cell so that the plate can be introduced into the cell and removed from the cell by the conveying means of the tank.

5. A device according to claim 1, which include mounting means for positioning the support means in each of the cells, said mounting means mounting the support means for reciprocal movement with an adjustable stroke in the cell parallel to the anode plates provided in said cell.

6. A device according to claim 5, wherein each of the anode plates has a width corresponding to the width of the workpiece holder, and each cell includes additional anode plates having a width corresponding to the maximum stroke of the workpiece holders in the individual cell and being aligned with the anode plates of the cell so that each of the work holders is disposed between the anode plates as it is being reciprocated by the means for mounting.

7. A device according to claim 6, wherein the conveying means of the electroplating tank includes additional lifting means for removing and introducing the additional anode plates as the other anode plates are being removed and introduced to each cell.

8. A device according to claim 1, wherein each of said lock means has a conveyor means for conveying at least two workpiece holders through the lock means, said conveyor means of the lock means and the conveying means of the tank each being capable of conveying the same number of workpiece holders.

9. A device according to claim 8, wherein each of the lock means has a housing receiving the liquid lock with the principal chamber being formed in the housing above the surface of the liquid of said liquid lock, each of said housings having at least one vertical shaft extending from a top thereof with a bottom portion of each shaft extending below the surface of the liquid in the liquid lock, each shaft having a closable opening for enabling insertion and removal of a workpiece holder therein, said shafts forming the antechamber of the lock means, wherein each of the conveyor means of the liquid lock is disposed in the housing below the surface of the liquid and is movable in a horizontal direction from a position below the shafts to a position below the closable openings connecting the principal chamber to the protective chamber of the tank.

10. A device according to claim 1, wherein the hood forming the protective chamber has a lower horizontal wall portion disposed at each end, said horizontal wall portion containing the closable openings in communication with the principal chamber of the lock means being disposed at said end, and wherein the conveying means of the tank include a horizontally movable truck supported in the hood for movement from one position vertically disposed above the horizontal wall portion at one end to a second position vertically disposed above the closable opening in the horizontal wall portion at the other end, said truck having vertically movable hooks for extending through said closable openings to engage times including workpiece holders and anode plates in the liquid lock and for moving the item through said openings into and out of the protective chamber, said vertically movable hooks being movable into each of the individual cells for positioning and removing anode plates and for positioning and removing workpiece holders.

11. A device according to claim 1, wherein said hood has lateral walls containing heat exchange elements.

12. A device according to claim 11, wherein said tank includes a wash bath in a vessel disposed in series with the individual cells, wherein the heat exchanger element in the lateral walls of the hood are cooling coils, and wherein each of the lateral walls beneath the cooling coils includes a condensation channel terminating for discharge into the wash bath.

13. A device according to claim 12, wherein the vessel of the wash bath has the same dimensions as the individual cells.

14. A device according to claim 1, wherein the tank includes a vessel for a washing bath, said vessel for the washing bath and the individual cells being of the same dimension.

15. A device according to claim 1, wherein each of the individual cells is provided with external heat exchanging means for treating the liquid disposed therein.

16. A device according to claim 1, wherein each of the individual cells includes means for controlling the level of liquid therein.

17. A device according to claim 1, wherein each of the individual cells is mutually connected to one another by compensating lines.

18. A device according to claim 1, wherein the liquids received in each of the cells includes toluol, each of the cells including means for heating the liquid in the cell, said means for heating having a temperature control to insure a toluol evaporation.

19. A device according to claim 1, wherein the conveying means is actuated by means of compressed air.

20. A device according to claim 3 wherein the spatial disposition comprises at least four workpiece holders being arranged in at least two rows.

* * * * *